United States Patent [19]

Gumbert

[11] Patent Number: 4,942,678

[45] Date of Patent: Jul. 24, 1990

[54] FOOTWEAR

[76] Inventor: Jerry F. Gumbert, P.O. Box 02011, Columbus, Ohio 43202-2011

[21] Appl. No.: 229,826

[22] Filed: Aug. 8, 1988

Related U.S. Application Data

[63] Continuation-in-part of Ser. No. 112,689, Oct. 22, 1987, abandoned.

[51] Int. Cl.[5] ..... A43B 1/00

[52] U.S. Cl. ..... 36/102; 36/11; 36/50; 24/713.4

[58] Field of Search ..... 36/102, 103, 105, 111, 36/112, 11, 27, 50, 88, 8.1, 4, 51, 7.1 R; 24/117, 140

[56] References Cited

U.S. PATENT DOCUMENTS

| | | | |
|---|---|---|---|
| 1,104,357 | 7/1914 | Hassel | 36/9 R |
| 1,291,958 | 1/1919 | Lund | 36/11 |
| 1,959,359 | 5/1934 | Hebig | 36/8 |
| 2,005,007 | 6/1935 | Sandler | 36/11 |
| 2,041,505 | 5/1936 | Woerle | 36/11 |
| 2,143,556 | 1/1939 | Hodaly | 36/50 |
| 2,305,926 | 12/1942 | Kohler | 36/9 R |
| 2,378,461 | 6/1945 | Bonyhady | 36/50 |
| 2,409,813 | 10/1946 | Timson | 36/105 |
| 2,483,525 | 10/1949 | Brust | 36/50 |
| 2,491,297 | 12/1949 | Brown | 36/105 |
| 2,721,399 | 10/1955 | Emmer | 36/57 |
| 2,926,434 | 3/1960 | Morgan | 36/102 |
| 2,958,012 | 10/1960 | Melman et al. | 36/50 |
| 2,973,589 | 3/1961 | Rigsby | 36/11 |
| 3,057,086 | 10/1962 | Rigsby | 36/112 |
| 3,142,911 | 8/1964 | Waters | 36/112 |
| 3,148,378 | 9/1964 | Tibbitts | 36/9 R |
| 4,145,822 | 3/1979 | Mitchell et al. | 36/9 R |
| 4,294,022 | 10/1981 | Stockli et al. | 36/9 R |
| 4,317,292 | 3/1982 | Melton | 36/9 R |
| 4,393,550 | 7/1983 | Yang et al. | 24/117 |
| 4,485,529 | 12/1984 | Blum | 24/117 |
| 4,541,186 | 9/1985 | Mulvihill | 36/44 |
| 4,619,058 | 10/1986 | Gumbert | 36/102 |
| 4,825,564 | 5/1989 | Sorce | 36/9 R |

FOREIGN PATENT DOCUMENTS

| | | | |
|---|---|---|---|
| 129014 | 7/1931 | Fed. Rep. of Germany | 36/8.1 |
| 618418 | 9/1935 | Fed. Rep. of Germany | 36/11 |
| 36166 | 3/1986 | Switzerland | 36/50 |

*Primary Examiner*—Steven N. Meyers

*Attorney, Agent, or Firm*—Wood, Herron & Evans

[57] ABSTRACT

An article of footwear comprising a unitary shell enveloping the foot, having a heel collar and an incision therein adapted to accommodate an inserted foot and including an intrinsic pattern of elastic interconnections between predetermined points on the shell corresponding to locations analogous to the natural foot physiology.

8 Claims, 7 Drawing Sheets

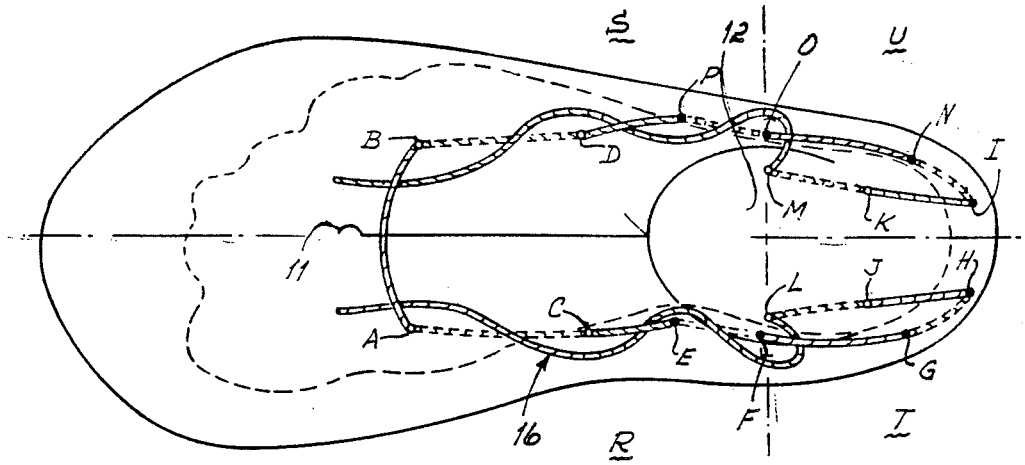
FIG. 4
FIG. 5A
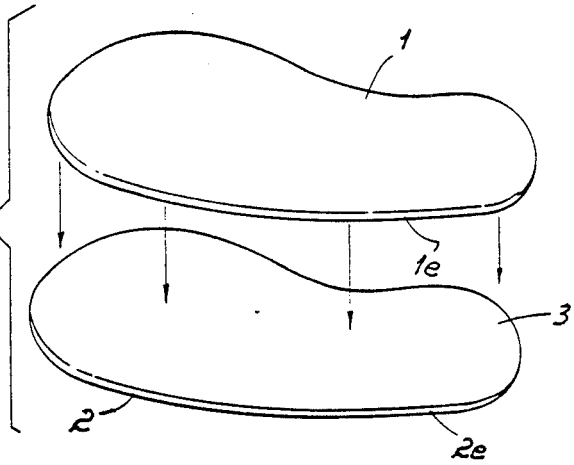
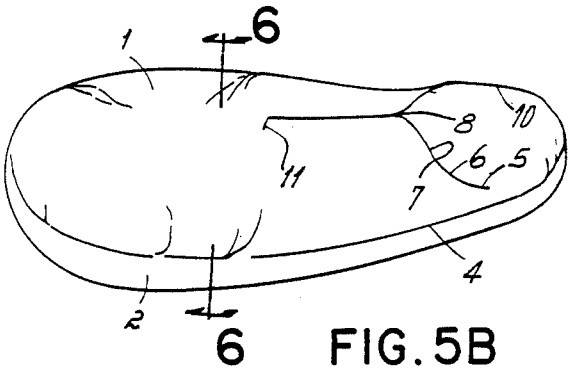
FIG. 5B
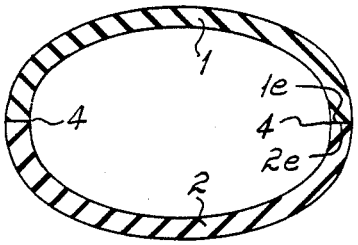
FIG. 6

FOOTWEAR

This is a continuation-in-part of copending application Ser. No. 07/112,689, filed Oct. 22, 1987 now abandoned.

FIELD OF THE INVENTION

This invention relates to footwear. A closed cell foam, leather or fabric envelope is structured with elastic interconnections to provide a "shoe" construed in the same manner and arrangement as the bones, muscles and tendons of the foot are physiologically interconnected.

BACKGROUND OF THE INVENTION

Footwear has always consisted of a sole, usually stiff, which is suspended by the upper part of the foot to a position beneath the foot. The upper part of the footwear that suspends the sole has been straps, leather uppers sometimes with elastic, sometimes with shoelaces, sometimes with leather thongs, Velcro fasteners and the like which have served to attach the footwear to the foot. That type of attachment is at best sometimes comfortable. That type of attachment, even though comfortable, has common shortcomings:

(1) They must be skin-tight in order to hold the shoe on the foot.

(2) They elevate the foot onto a stiff platform.

(3) Most place the heel of the foot and the ball of the foot on different planes.

(4) All conventional footwear hangs on the foot.

The consequence of the foregoing artificial manner in which the foot is supported for contact with the ground is that the conventional footwear tends to promote atrophy of the foot muscles; muscle groupings; improper contact of the foot to the ground; constant tension in the legs, hips, back, neck, and shoulders; development of callouses, bunions and corns; reduction of the circulation in the feet and lower limbs; susceptibility of loss of balance, breaking the bones.

Cushioning in a shoe helps, but that comes at a cost: loss of stability. The most stable arrangement is a bare foot running on flat ground. When anything is put between the two, the chance for wobbling and tipping over increases. Cushioning exaggerates pronation, that is, the rotation of the foot toward the instep. Too much rocking and twisting around ankle and knee joints invariably tears or inflames muscles, tendons and ligaments. This trade off—cushioning versus stability—is the designer's dilemma, the yin and yang of athletic shoe making.

SUMMARY OF THE INVENTION

It has been an objective of the present invention to provide footwear that involves a totally different manner of connecting footwear to the foot with the consequent elimination of many of the disadvantages of conventional footwear.

Broadly, the invention consists of providing footwear that enables the wearer to enjoy the stability and freedom of operation of the bare foot while providing the cushioning of state of the art footwear that permits the wearer to walk on the types of surfaces encountered today.

This objective of the invention is attained by providing a soft and flexible shell and an elastic attachment of the shell to the foot in such a way that the shell, as closely as possible, functions as an outer skin on top of the existing skin of the human foot. More particularly and preferably, the shell is a foam material having a thickness of at least ⅛ inch. An elastic band is disposed around the opening of the shell through which the foot enters, the elastic band being connected to the shell to impart forces (tension) to the shell in substantially the same direction that the tendons of the foot apply forces to the bones to manipulate the foot bones. As the foot bones are manipulated side to side and fore and aft, the elastic band causes the shell to follow the foot manipulations as if it were another layer of skin. Thus, as the foot is rotated either side to side or fore and aft, the elastic band on one half of the foot will be stretched and on the other half of the foot it will be contracted, thus urging the shell to return to its original state just as the muscles and tendons of the foot urge the foot to its original state when the foot is rotated. In this way, the footwear follows and duplicates the tendon and muscular action of the foot rather than resisting or sliding with respect to the foot as is the case with conventional footwear.

The "lower" of the footwear is critical. Its shape, before the foot is inserted and weight is applied to the ground, is convex when viewed externally in cross section across the ball of the foot. When the foot is inserted into the footwear, the lower will wrap around the side edges of the foot, thereby assuming the side contours of the foot. The lower is formed principally of a cushioning foam that may be as much as ⅝" thick. The outer surface is covered with an abrasion-resistant material such as nitrile rubber that is approximately 0.002-thick. The footwear preferably has placed at the major support portions of the foot, the ball and heel, a layer of SORBOTHANE material manufactured by the British Tire & Rubber Company. SORBOTHANE is a material specially designed to disperse shock in footwear.

Thus, the footwear of the present invention will permit the foot to assume its natural shape as weight is put upon it. In a stride, the footwear of the present invention will permit the pressure to distribute itself in a natural curve (sine wave with harmonics) as weight is shifted from the back to the front of the foot. Thus, the lower of the present invention avoids or eliminates the following disadvantages of state of the art footwear: confining of lateral and longitudinal expansion of the foot when pressure is placed upon it; rendering the sole of the foot totally static by confining it to a rigid platform; focusing of stress on the ankles, knees and hips, preventing them from operating naturally and restriction of natural pronating and supinating motion.

Contrasting the invention to conventional footwear, footwear of the invention will conform to the foot, whereas with conventional footwear, the foot must conform to the shoe.

In the invention, the predetermined physiological area of the foot is enveloped with a foam or other pliable material by constructing an outer shell that is analogous to an additional epidermal layer of tissue and skin. This shell is then laced with an elastic cord in a manner such that the pliable shell can mimic movements of the foot without restriction. An outer covering may overlay the shell and is selected to accommodate the surface abrasion expected on the covering surface. Preferably, the shell is constructed by a fusion process such as gluing or welding, rather than sewing. If a sewing process were used, the stitches employed would cause an unequal distribution of stress and apply different degrees of pressure to the body part encircled. It is not, however, an intention of the application to exclude from the scope of the invention a stitching process whereby stitches are adopted to accommodate an elastic expansion and contraction. The elastic lacing pattern of the invention accommodates action of the tendons and secures the footwear of the invention to the body in a manner comparable in function to corresponding anatomical connections of body parts.

The materials used in the invention mimic anatomical parts. For example, the closed cell foam envelope is an analog for muscle and adipose tissue; a leather or fabric overlay mimics an outer covering of skin; and the elastic cord lacing corresponds to tendons. In sum, an anatomical analog, such as of the foot, is provided in an apparel construction, such as a shoe.

One of the features of the invention is that it can be formed by two substantially identical pieces of sheet foam material having their edges turned toward each other and glued in abutting relation to form a hollow shell. An opening to which the foot may enter is formed in the shell. Elastic interconnections are made on the shell around the opening in such a way as to draw the shell into snug conformity with the outline of the foot and to act as a skin surrounding the foot.

As another feature of the invention, the elastic interconnections at the most anterior and most posterior portions of the shell are above a median line dividing the shell into upper and lower halves. A plurality of interconnections of the elastic band to the shell intermediate the most anterior and posterior portions are below the median line. This relationship causes the band to tend to apply tension to the shell in substantially the same direction that the tendons apply tension to the foot bones.

Another feature of the invention resides in the forming, on each side of the area of the heel, a truss consisting of an elastic band running from the arch to the bottom of the heel to a flap alongside the achilles tendon and back to the arch.

The footwear in accordance with the present invention may be formed by passing an elastic band through eyelets formed in the shell at the locations described above. It may provide for tightening the elastic band by the wearer after the footwear has been applied to the wearer's foot or the elastic connections may be pretensioned so that upon application to the foot of the appropriate size, the appropriate amount of tension is applied to the elastic connection. The elastic connection may be first formed as a matrix and a foam shell molded in situ around it. The footwear may be formed by two plies of flexible material sandwiching between them a padding with the flexible connection having been stitched to the inside surface of one of the plies before the plies are joined together in the sandwich.

BRIEF DESCRIPTION OF THE DRAWINGS

These and other objects of the invention are more fully understood with reference to the following description of the preferred embodiment taken in conjunction with the accompanying drawings in which:

FIG. 4 is a top view showing the portion of a foot in the footwear and indicating physiological points for connecting relationships of the lacing structure;

FIG. 5A shows an intermediate step in construction of the footwear with two sides formed;

FIG. 5B shows an initial balloon structure for the footwear;

FIG. 6 is a cross-sectional view taken along line 6 of FIG. 5B;

DESCRIPTION OF THE PREFERRED EMBODIMENT

Figure 1:
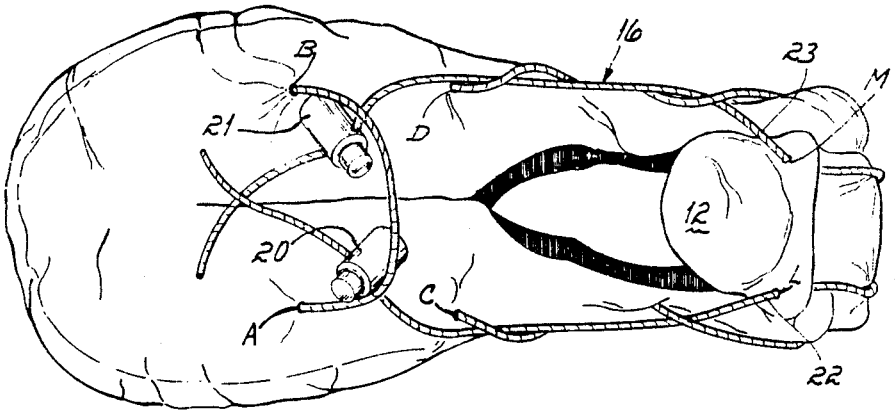
FIG. 1 is a top view of footwear of the invention.

The invention is an item of footwear provided in a manner such that in an outer shell covering for the foot, the physiological/anatomical structure of the foot is mimicked by a footwear construction that mimics an "epidermal" layer. Rather than being simply a "covering" for the foot or a "shoe" as that item is commonly understood, the footwear of the invention is more accurately described as a realistic extension of the foot physiology. The footwear construction "worn" is intrinsically interrelated to the foot physiology.

The following sequence illustrates an example of a manner in which footwear of the invention is constructed.

If done on a custom basis, an outline of the foot is first made, allowing a sufficient "oversize" for the length and breadth of the foot to accommodate movement when in action. The pattern is used to determine the cut of two identical pieces of a pliable foam material so that an upper and a lower piece are provided. The pieces should be thick enough to provide comfort to the wearer during walking or running on uneven surfaces such as gravel. A minimum thickness is about $\frac{1}{8}''$. These are shown as 1 and 2 of FIG. 5A. The top of the lower piece of foam, 2, on which the foot will actually rest, may be covered with double-split leather, 3, to provide protection as well as positive traction. An adhesive or glue is applied to the outer side edges of both pieces of foam, 1*e* and 2*e*, FIG. 6, and the two pieces are mated edge to edge—starting at the most anterior "toe" portion, then gluing the posterior "heel" portion and then the lateral and medial sides to provide a single seam, shown in FIG. 5B at 4. A shell or balloon which will envelope the foot is thereby formed. The plantar, sole surface of the shell formed from material piece 2 is covered with a protective layer of double-split leather and the dorsal surface formed from material 1 is covered with fabric, leather or some other covering or combination depending upon anticipated use of the footwear.

The plantar surface may also be covered with a rubber sole of a nature determined by anticipated use of the shoe.

After the shell envelope is formed, an incision is made, with reference to FIG. 5B, beginning on the dorsal surface of the shoe at the posterior of the heel area on the lateral side 5 and proceeding forward in a gently arching fashion so that the incision will remain below the lateral malleolus, 6, and then curving more sharply toward the axis of the foot 7 after passing the malleolus. [As used herein, reference to anatomical features is derived from *Color Atlas of Foot and Ankle Anatomy,* McMinn, R.M.H., et al. Appleton Centure; C1982 Wolfe Medical Publications, Ltd., London; Library of Congress Catalog Number 82-50763, particularly pages 56, 57, 58 and 59, which are incorporated by reference herein.

After crossing the longitudinal axis of the foot, 8, the incision curves downward below the medial malleolus and extends backwards toward the posterior medial part of the heel 10. A resulting tab of material is formed which becomes the achilles flap 12 and rests against the achilles tendon. A second incision is then made along the longitudinal axis of the foot from the most anterior point of the curved incision described above 8 forward to approximately the most anterior point of the cuniform bones of the foot, 11.

Elastic bands under tension that cause the footwear to conform to the foot surround the opening or incision. The points of connection of the elastic band to the shell are made in relation to a horizontal median line that divides the shell into upper and lower halves of equal mass. The median line is actually the line dividing the foot (all structure below the ankle) into equal upper and lower masses. As long as the upper edge of the shell is just below the ankle, the median line based on the foot is substantially the same as a median line based on the shell mass. That median line is indicated in FIG. 1 at 15. In FIGS. 1–6, the elastic band is shown as a cord 16. The most anterior and most posterior points of connection of the cord to the shell are above the median line 15. The most anterior points are indicated at A and B, and the most posterior points are indicated at J and K or I, and M on the achilles flap. Between those points of interconnection are points of connection that are below the median line such as points EP, FO, GN and HI.

Figure 2:
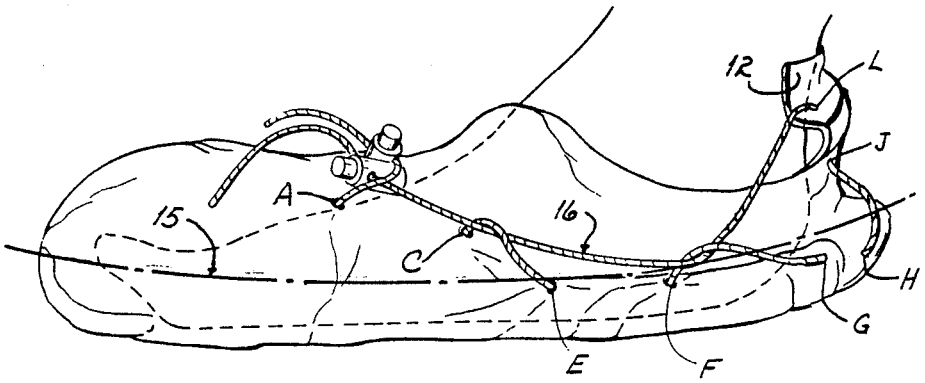
FIG. 2 is a medial side view.
Figure 3:
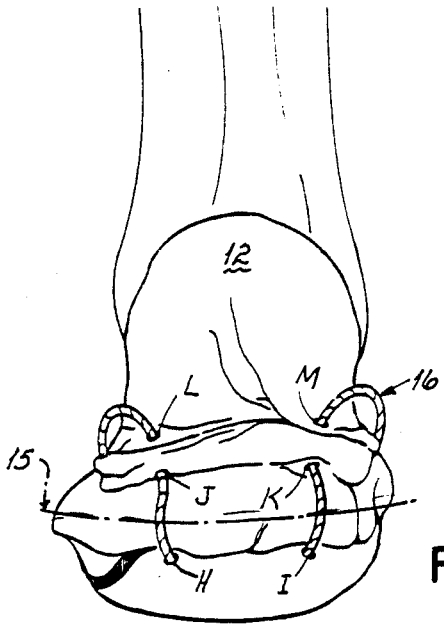
FIG. 3 is a view from the back showing the heel configuration.

In the preferred form of the invention, sixteen holes are formed in the shell at the relative positions indicated in FIG. 4 and as also shown in FIGS. 1–3 by the stated letters:

(A) above the base of first metatarsal and corresponding to the extensor longus hallucis;

(B) above the base of the 4th metatarsal and corresponding to the extensor longus digitorim;

(C) to the side of the most anterior, inferior aspect of the medial side of the extensor retinacumul;

(D) to the side of the peroneus tertius and corresponding to the lateral side of the extensor retinaculum;

(E) corresponding to the attachments of the tibialis anticus;

(F) corresponding to the attachments of the tibialis posticus;

(G) to the medial side and anterior portion of the calcaneus and corresponding to the flexor retinacumul;

(H) corresponding to medial inferior attachment of achilles tendon;

(I) corresponding to lateral inferior attachment of achilles tendon;

(J) and (K) in the heel tab (approximately 2" above the inferior attachments) corresponding to the medial and lateral superior aspects of the calcaneus and the planaris;

(L) and (M) (approximately 3"–3½" above the inferior attachment in heel tab approximately 1.0 to 1.5 inch above holes (J) and (K) slightly further to the medial and lateral aspects and corresponding to where the soleus attaches to the achilles tendon;

(N) on lateral and anterior part of calcaneus and corresponding to the peroneal retinacumul;

(O) on lateral side of foot below the lateral malleolus and corresponding to the abductor minimui digiti and peroneus longus;

(P) to the side of the attachment of the peroneous brevis.

These sixteen locations provide connecting points for an integrated elastic cord. In each of the drawings, each letter is uniformly used to indicate the same physiological location.

The elastic interconnection between these points is predetermined because movements of the foot upon the ankle joint involve four types of action: (1) inversion—the turning of the sole of the foot inwards; (2) eversion—the turning of the sole of the foot outwards; (3) flexion—pulling the toes of the foot to the front of the leg; and (4) extension—the drawing up of the heel of the foot while simultaneously pointing the toes downward.

Inversion of the foot is accomplished primarily by the tibialis anticus and tibialis posticus muscles. Eversion is accomplished primarily by the peronei muscles (peroneous longus and peroneous brevis). Normally these two groups of muscles antagonize each other causing the sole of the foot to be neutral (neither inverted nor everted). The extreme eversion of a foot occasionally seen when the lower end of the fibula has been fractured is caused by the lack of resistance normally offered by that bone to the peronei muscles.

Extension of the tarsal bones upon the tibia and fibula is produced by the muscles gastrocnemius, soleus, plantaris, tibialis posticus, peroneus longus and brevis, flexor longus hallucis and flexor longus digitorium. Flexion of the tarsal bones upon the tibia and fibula is produced by the muscles tibialis anticus, peroneus tertius, extensor longus digitorium and extensor proprius hallucis. Again these two groups of muscles antagonize each other and when operating properly hold the foot in a position of equilibrium.

In a similar fashion the lacing pattern of the footwear herein securely holds the shoe on the foot while allowing complete freedom of movement through the use of antagonizing groups of holes and laces. The eight holes on the medial (inside) side of the shoe invert the sole of the shoe. (Holes A, C, E, F, G, H, J, L). The eight holes on the lateral (outside) side of the shoe evert the sole of the shoe. (Holes B, D, I, K, M, N, O, P).

Eight holes anterior to the lateral arch of the foot, four (A, C, E, F) on the medial side, and four (B, D, 0, P) on the lateral side, flex the toe, while eight holes posterior to the lateral arch, four (I, K, M, N) on the lateral side extend the shoe.

While sixteen points of interconnection are shown in the embodiment of FIGS. 1–6, it should be understood that the invention is not limited to that precise number of connecting points. Further, as shown in the embodiments of FIGS. 7 to 11, there may be no precise points of interconnection. The important consideration is that the elastic band or cord be under tension so as to pull the shell against the foot in generally the same direction as the tendons of the foot pull on the bones of the foot.

Considering the shell to be divided into four quadrants when viewed in plan as shown in FIG. 4, the quadrants are forward inside R, forward outside S, rearward inside T, and rearward outside U. When the foot is at equilibrium, the sole is neither inverted, everted, flexed, or extended. If the foot is rotated with respect to the ankle, fore, aft, or side to side, two adjacent band quadrants will be stretched and the opposite band quadrants will contract. For example, referring again to FIG. 4 on inversion, the turning of the sole of the foot inwards, the bands in quadrants S and U will be stretched and the bands in quadrants R and T will be contracted. If the foot is flexed, pulling the toes toward the front of the leg, the bands in quadrants T and U will be stretched and the bands in quadrants R and S will be contracted.

An elastic shock cord may be used as a lacing material (approximately 60" of cord is used in a men's size 11–12). As shown in FIG. 4, lacing begins at the two most anterior holes A and B so that a loop is formed over the upper exterior surface of the shoe connecting the two holes. The lacing continues from front to back with the medial and lateral sides laced separately. Thus, exterior stitches connecting adjacent "holes" are formed along the medial (A to C to E to F to G to H as shown in FIG. 2), and lateral (B to D to P to N to I) sides of the foot, upwards adjacent the arch of the foot, upwards in alignment to the cuboid bone. The laces are then stitched through the heel to form a collar around the achilles tendon, leaving the laces on the footwear exterior. The loose ends of the laces are then respectively drawn back on each side through the medial exterior stitches F and G and lateral N and O stitches and are again looped through the most exterior stitch on each side (C to E) and (D to P). The medial lace remains on the medial side and the lateral lace remains on the lateral side. Both ends of the lace are inserted under &he initial loop made connecting the two anterior holes A and B. Spring locks or other stops such as shown in FIG. 1 at 20 and 21 may be attached to the two ends of the lace and the footwear is then completed. If additional tension is desired, the lace may be drawn backward and inserted under the exterior loops formed by the lace as it was threaded from the heel through the first exterior stitch, i.e., in the locations indicated as 22 and 23 in FIG. 1.

In contrast with conventional shoes, a stiff sole is unnecessary and the footwear herein has no edges. There is neither a positive nor a negative heel and the arch has no shank. There can be a greater length and breadth of shoe without sloppiness of action and the footwear is balanced, both at rest and in motion. The invention does not "hang" on the foot from above but is supported and attached to the foot by the elastic bands pulling generally in the direction of the tendons in the foot. The invention is adjustable to sock thickness, foot swelling, foot growth, and other wear variables. It may be made fully waterproof and "breathable" by adopting the material of construction and/or providing ventilating holes. The invention allows extension and flexion of the achilles tendon and provides improved traction through a broader surface area in which natural contact points of the foot strike first. In this regard, the footwear herein may eliminate the need for spikes in athletic shoes.

The ease and simplicity of construction permits the economical "custom" fabrication of footwear to accommodate left/right foot differences in persons. Since there is one basic pattern piece and lasts are not required, the shoe can be built economically on a custom basis. The footwear is light in weight at rest and virtually weightless in action; it provides modest uniform pressure across the entire foot and hence may reduce the severity and/or incidence of podiatric maladies such as blisters, callouses, corns, bunions, hammer toe, and ingrown nails. Circulation is improved and foot, leg and back fatigue, as well as the stiffness in hips caused by conventional footwear, is reduced. The footwear is soft, adjustable and conforms to the foot and does not force the foot to conform to the shoe as in conventional shoes.

While the suitable physiologically appropriate materials of construction may be materials such as padded and/or quilted materials, a preferred "envelope" material for the footwear shell is manufactured by Uniroyal, Inc. under the trademark ENSOLITE comprising a closed cell foam made from polyvinyl chloride and nitrile rubber manufactured in nominal thickness of from 0.125 inch to 1.75 inch. Typical elastic lace materials include a cord of nominal diameter of 0.187 inch which will stretch 50% under a weight of 3 pounds, 75% under 5 pounds and 100% under 7 pounds and a similar cord 0.250 inch in diameter which will stretch 50% under 10 pounds, 75% under 12 pounds and 100% under 20 pounds. As in most items of apparel, size, comfort and purpose, given the predetermined design, are factors determining the specific materials and their strength and durability requirements needed for a given product.

Figure 7:
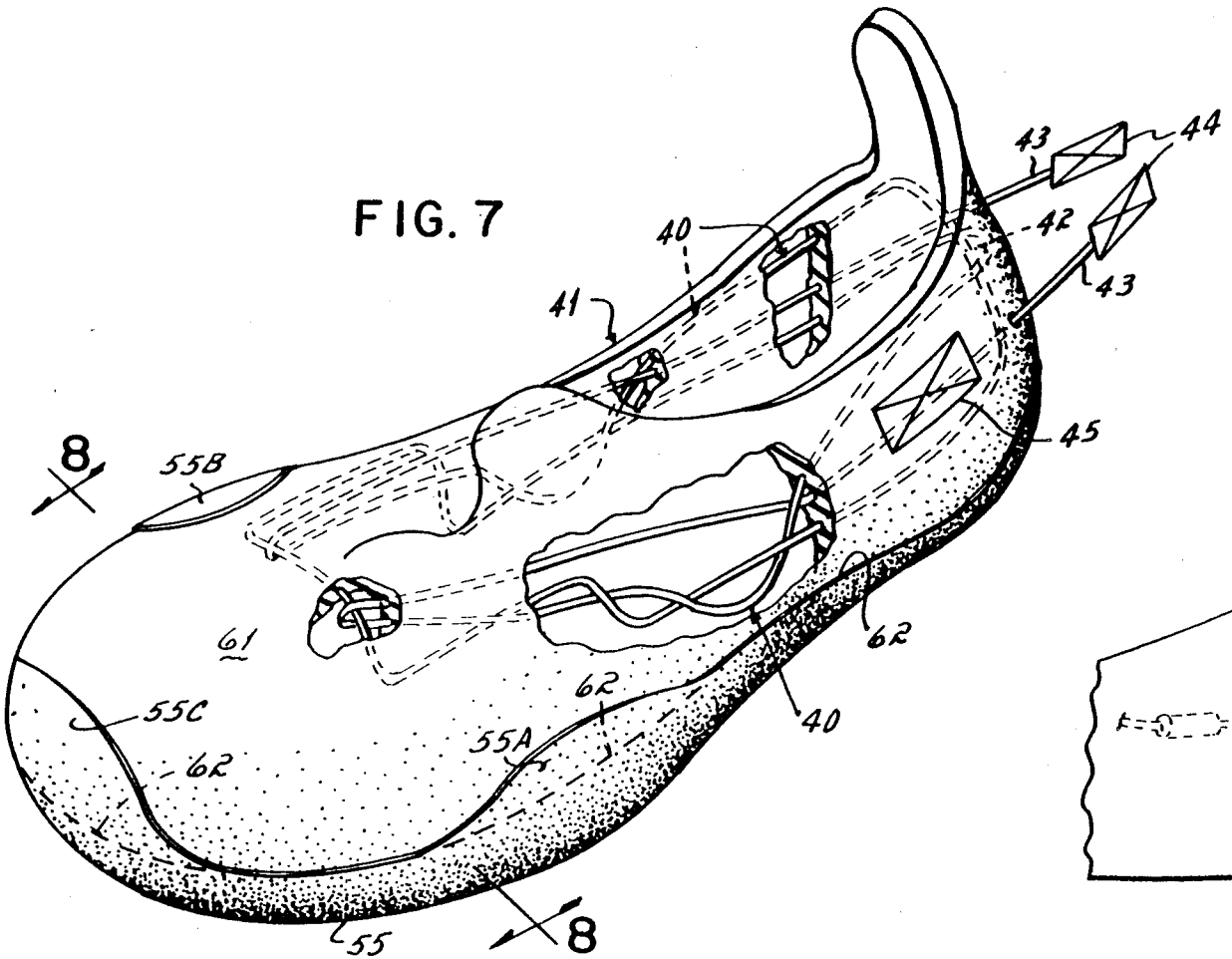
FIG. 7 is a perspective view of an alternative embodiment.

An alternative form of the invention is illustrated in FIG. 7. In that form of the invention, it is the objective to conceal the elastic bands and to provide an efficient manufacturing process.

As shown in FIG. 7, a matrix 40 of elastic band material is preformed. It has the configuration of the elastic cord of FIGS. 1–5. The elastic matrix is supported by a suitable jig in a mold and a thick foam shell 41 is molded around it, with the matrix being disposed within the inner and outer walls of the molded shell. The length and width of the matrix will be undersized compared to the foot that is to be inserted into the shell so that when the foot is inserted into the shell, the matrix will be stretched, thereby placing all of the band elements between connection points under tension.

It should be noted further that in this form of the invention the elastic bands at the heel are crossed as at 42, thereby differing somewhat from the configuration of the cord illustrated in FIGS. 1–5.

As shown in FIG. 7, the elastic matrix has free ends 43 projecting from the heel portion of the footwear. Those ends are preferably flat and have one-half the Velcro fastener affixed to the surface as indicated at 44. A patch of the other half of the Velcro fastener is indicated at 45 and lies alongside the shoe. This fastener permits the wearer to insert his foot into the shoe and to stretch the elastic bands that secure the ends in a tidy, attractive manner.

Alternatively, the area above the arch could be used for the attachment of the Velcro fasteners with the ends of the elastic matrix projecting from that area of the footwear.

The footwear of the alternative embodiment of FIGS. 7–10 is formed of a lower 50 and an upper 51. The lower has darts 52 in the heel area that will be brought together to enable the heel portion of the lower to be brought snugly around the heel of the wearer. The upper has an internal dart 53. The edges forming the dart will be brought together to enable the upper to conform snugly about the arch area of the wearer.

Figure 8A:
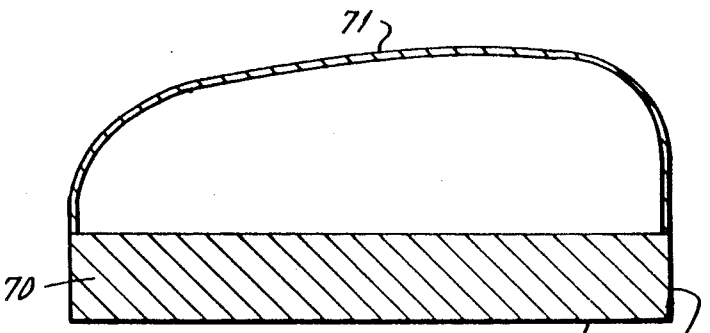
PRIOR ART FIG. 8A
FIG. 8A is a cross-sectional view through a comparable plan taken of a traditional shoe.
Figure 8:
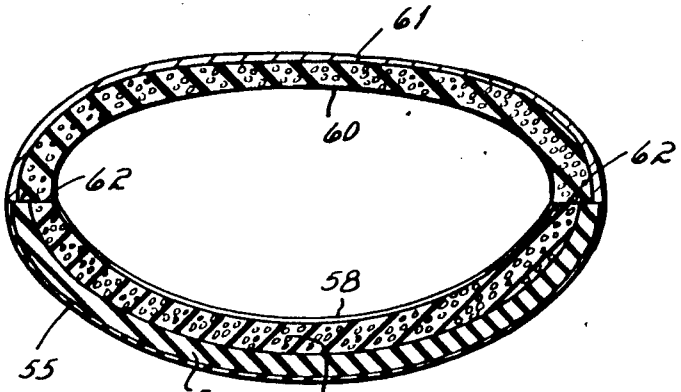
FIG. 8 is a cross-sectional view taken along lines 8—8 of FIG. 7.

Referring to FIG. 8, the preferred cross section of the upper and lower is illustrated. The lower has an outer ply 55 of an abrasion-resistant material such as nitrile rubber. That ply may be about 0.002" thick. Adjacent the outer ply 55 and placed at the selected lead-bearing areas, namely, the ball of the foot and the heel of the foot, is a layer 56 of SORBOTHANE of about ⅛" to 3/16– thick. Covering the complete lower is a ply of cushioning foam 57 also about ⅛" to ⅜" thick. Overlying the cushioning foam is a liner 58 of cotton or other material conventionally used to line the inside of footwear.

The upper will have a ply of cushioning material such as foam of some thickness indicated at 60. An outer covering of attractive material such as leather or GORE-TEX 61 overlies the cushioning material. The upper will be joined to the lower by an adhesive along a median line 62 as shown. Across the ball of the foot, the transverse dimension of the upper is substantially the same transverse dimension as the lower so that the same line 62 is approximately midway of the cross section. In its unstressed condition, the foam material assumes the convex (viewed from the outside) configuration as shown in FIG. 8. When the foot is inserted and pressure is applied by the foot to the ground, the footwear assumes the configuration shown in FIG. 9. There, it can be observed that the footwear permits the foot to spread laterally in a natural manner. There is no confining lower platform to apply stresses to different areas of the foot. The foot has not been elevated onto a platform.

Figure 9A:
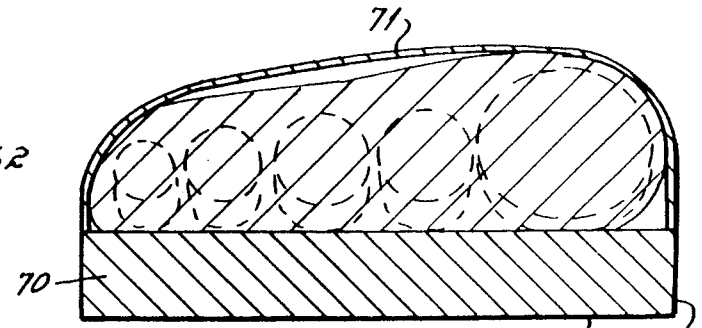
PRIOR ART FIG. 9A
FIG. 9A is a view similar to FIG. 8A with the foot inserted and pressure applied.
Figure 9:
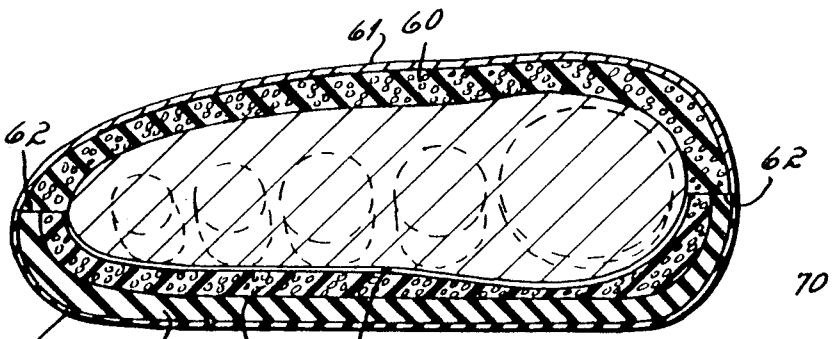
FIG. 9 is a view similar to that of FIG. 8 with a foot inserted and pressure applied.
Figure 10:
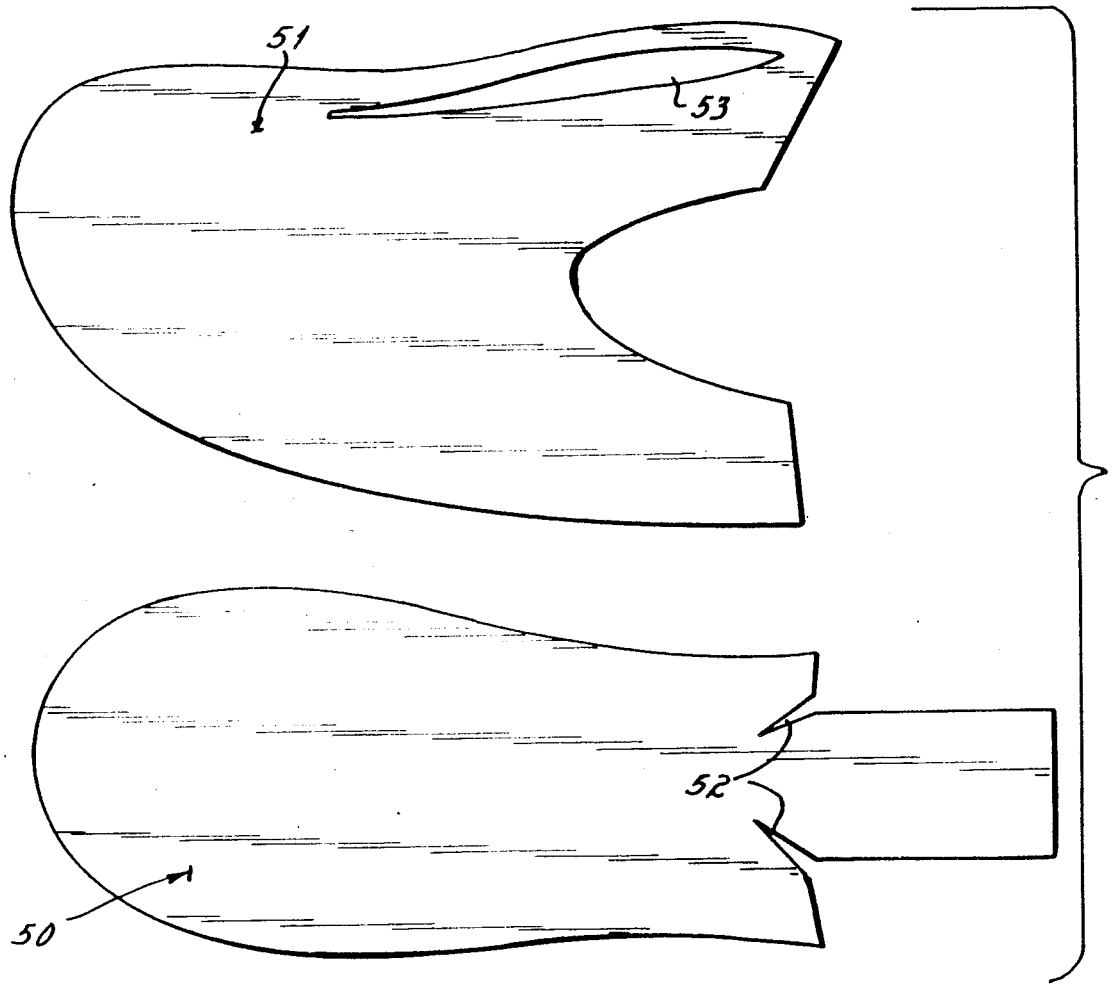
FIG. 10 is a disassembled plan view of the lower and upper elements of the shoe in a flat condition.

Contrast what is shown in FIGS. 8 and 9 to the comparable prior art shoe of FIGS. 8A and 9A. In FIG. 8A, the footwear consists of the lower or platform 70 and a flexible upper 71. The sides of the platform 70, indicated at 72, are generally perpendicular to the plane of the bottom surface 73 of the platform. To the extent that cushioning is a part of the platform 70, the platform becomes thick and may be as thick as ⅝" to ¾". At the heel, the thickness is considerably greater. Referring to FIG. 9A when the foot is inserted into the traditional shoe, the combined upper and lower platform causes the foot to assume the shape of the shoe rather than the shoe assuming the shape of the foot as is the case with the present invention. The foot is laterally bunched into the shoe. When pressure is applied, as shown in FIG. 9A, it can be seen that the foot does not spread naturally but remains confined and stressed within the interior or the shoe. Further, it can be seen that the wearer is placed on an elevated platform with the resultant loss in stability. Further, it can be appreciated that the shoe locks up the foot in such a way that during the stride the foot cannot move naturally with respect to the ground. Rather, the foot moves as dictated by the shoe with consequent stress to the ankle, knee and hip.

It is preferred that the abrasion-resistant material 55 be configured to overlie the areas of the shoe that normally tend to be scuffed during normal wear as shown at 55A, 55B and 55C.

Figure 11:
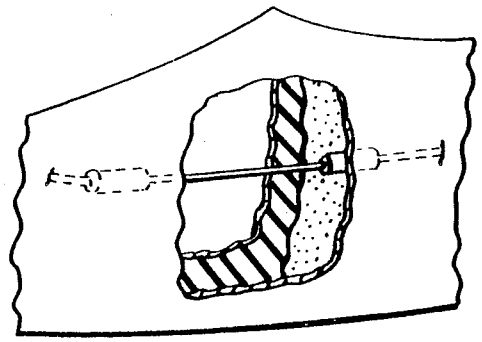
FIG. 11 is a fragmentary view partly in section of another alternative embodiment.

In another alternative form of the invention shown in a fragmentary view of FIG. 11, the shell is formed of an outer liner 80, an inner liner 81 and foam or padding 82 between the liners. The elastic matrix 84 (similar to matrix 40 of the embodiment of FIG. 7) is disposed within the liners. At the points of interconnection, the elastic bands pass through sleeves 85 instead of the holes or eyelets shown in FIGS. 1–5.

In the embodiments of FIGS. 7 to 11, it may be desirable to have two ends of the elastic matrix available for tying in order to change the tension on the elastic bands. Alternatively, the matrix would be formed with no free ends with the matrix being stretched to apply tension as the person inserts his foot into the shell.

Still another embodiment of the invention is illustrated in FIGS. 12 to 17. In this embodiment of the invention, the shell 80 is formed to follow closely the contour of the foot. It may be considered to consist of two halves of approximately equal mass above and below a median line 62. The shell has a heel area 81, an ankle area 82 and a forefoot area 83. It can be seen from FIGS. 14 and 15 that in the ankle area, at the arch of the foot, the exterior contour of the shell has a rather severe concave configuration at 85 so as to conform to the actual contour of the foot. Further, in the forefoot area, at the lateral side of the foot, there is a convex configuration at 86 which is significantly more pronounced than is found in a conventional shoe so as to allow adequate space specifically for the fifth metatarsal and little toe. On the medial side, at 87, there is a convex portion 88 and a concave portion 89 that conform to the head of the first metatarsal and the big toe.

Figure 12:
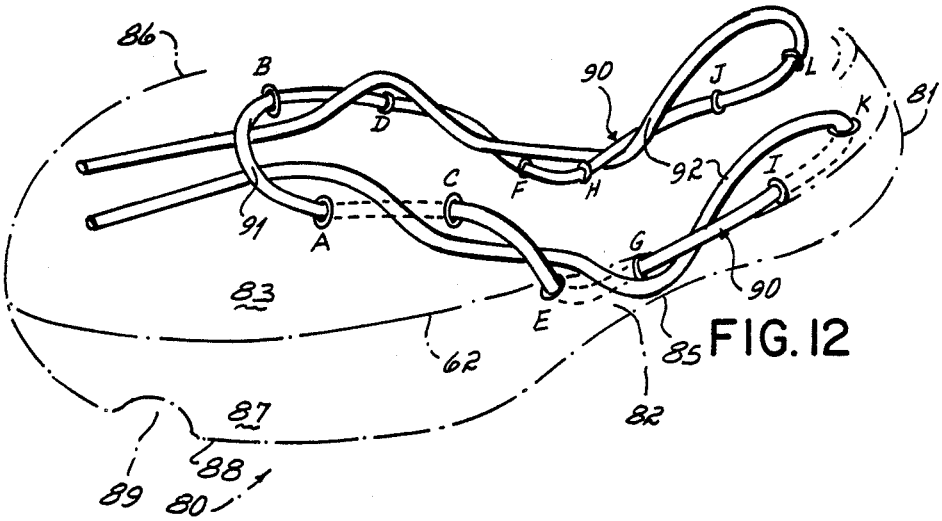
FIG. 12 is a diagrammatic perspective view illustrating a twelve-connection elastic matrix of still another embodiment of the invention, the matrix being in an untensioned state.
Figure 14:
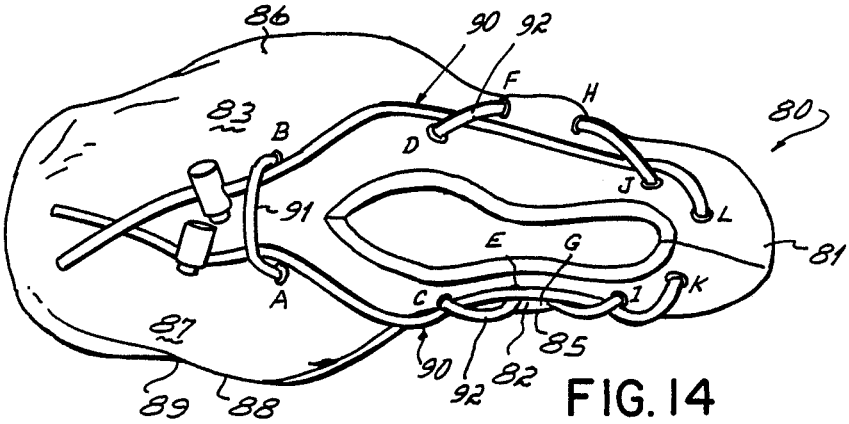
FIG. 14 is a top view of the embodiment of FIG. 12.

A twelve-connection elastic matrix is shown in FIGS. 12 and 14, the elastic matrix having six connection points on each side. In the illustrated form of the invention, these connection points are shown as eyelets A . . . L. It should be understood that some form of connection other than eyelets could be employed. On the medial side of the shell, two eyelets A and C are within the forefoot area of the shell above median line 62; two eyelets E and G are within the ankle portion 82 of the shell 80 below median line 62; two eyelets I and K are within the heel portion 81 of the shell 80 above median line 62. Similarly, on the lateral side of the shell, eyelets B and D are within the forefoot area 83 above line 62; eyelets F and H are within the ankle area 82 below line 62; and eyelets J and L are within the heel area 81 above line 62.

On each side of the shoe a first elastic portion 90 is threaded through the six eyelets and looped across eyelets A and B at loop 91. A second elastic section 92 on each side of the shoe extends from the rearmost eyelet K or L to the foremost eyelet A or B and underlies loop 91 of the elastic section 90. The section 92, when pulled tight (FIG. 13) extends generally parallel to the median line 62.

Figure 13:
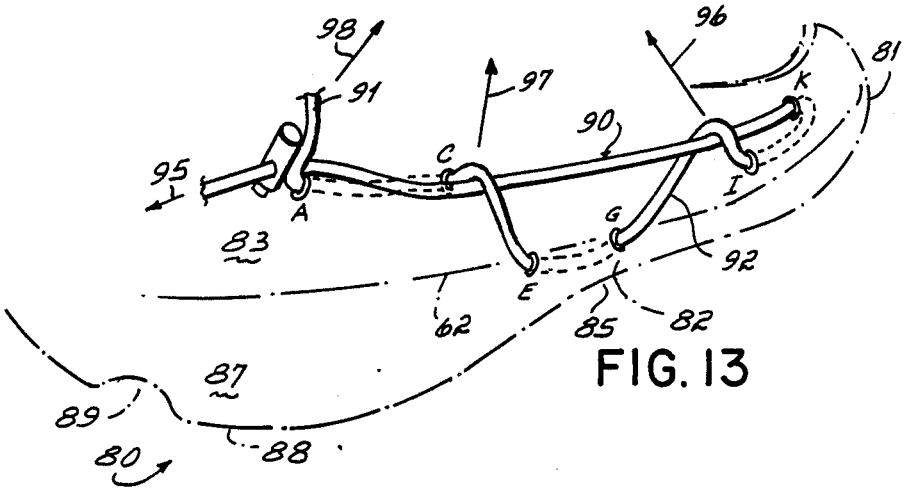
FIG. 13 is a fragmentary view similar to FIG. 12 except that the matrix is under tension.

Referring to FIG. 13, the medial side of the shell, when the elastic section 92 is stressed in the direction of the arrow 95 and held against the loop 91, the elastic section 92 applies lifting forces to the elastic section 90. The lifting force at the heel area will be generally in the direction of the arrow 96. Adjacent eyelets C and D the force will be generally in the direction of the arrow 97, and at eyelets A and B the force will be generally in the direction of the arrow 88.

By applying the forces to the elastic section 90 at the points and in the directions 96 and 97, the elastic 90 pulls upwardly against the eyelets E and G. Substantially identical forces are applied by the corresponding elements on the lateral side of the shell. There is generally a convergence of the force factors at a point in space centrally about 18 inches above the ankle of the area of the shell. Thus, there is an overall lifting effect drawing the lower portion of the shell upwardly against the foot.

With reference to FIGS. 12 and 14, the following explanatory text details the actual locations and construction of the matrix and its interrelationship with the human body.

| Eyelet Location | Action | Corresponding Anatomical References |
|---|---|---|
| A. | Draws the medial forefoot of the shell upwards toward the anterior, upper middle part of the fibula. | The Extensor Longus Hallucis arises from the anterior surface of the fibula (middle half), internal to the extensor longus digitorium, and is inserted into the base of the distal phalanx of the great toe with thin prolongations to each side which cover the surface of the joint (expansion from inner side to base of first phalanx). |
| B. | Draws the lateral forefoot of the shell upward toward the anterior, upper part of the tibia and fibula. | The Extensor Longus Digitorum arises from the outer tuberosity of the tibia and upper ¾ of anterior fibula, etc . . . divides into four slips and is inserted into the medial and distal phalanges of the four lesser toes. |
| C. | Keeps tendons in place and controls the angle of draw. | Medial side of the Extensor Retinaculum. |
| D. | Keeps tendons in place and controls the angle of draw. | Lateral side of Extensor Retinaculum. |
| E. | Draws the anterior medial portion of the ankle area of the shell upwards toward the anterior, upper ⅔ of tibia and inverts the shell. | Tibialis Anticus arises from outer tuberosity of the tibia and upper ⅔ of the shaft of tibia, interosseous membrane, etc. It passes vertically downward and is inserted into the inner and under surfaces of the internal cuneiform bone and the base of the first metatarsal. |
| G. | Draws the posterior medial portion of the ankle area of the shell upwards toward the posterior, upper half of fibula and inverts the shell. | Tibialis Posticus is the most deeply seated of all the muscles of the leg. It arises from the whole of the posterior surface of the interosseous membrane, outer surface of posterior surface of the shaft of the tibia (upper ⅓), and upper ⅔ of the inner surface of the fibula. |

-continued

| Eyelet Location | Action | Corresponding Anatomical References |
|---|---|---|
| | | The tendon passes through the groove behind the medial malleolus and over the internal lateral ligament and is inserted into the tuberosity of the navicular and internal cuneiform bones. It also sends fibrous expansions to the sustentaculum tali of the os calcis and to the middle and external cuneiforms, the cuboid and to the bases of 2nd, 3rd and 4th metatarsals. |
| I. | Keeps tendons in place and controls the angle of draw. | Medial, anterior portion of Flexor Retinaculum. |
| KL. | Draws the posterior and inferior portions of the heel area of the shell upwards toward the inferior, posterior portion of the femur. | The Achilles Tendon is the common tendon of of the gastrocnemius and soleus.<br><br>Gastrocnemius - Arises by two heads which are connected to the condyles of the femur. The Medial head arises from the upper back part of the inner condyles and the adjacent part of the femur. The lateral head arises from the outer side of the outer condyle and from the posterior surface of the femur immediately above the condyle. Each spreads out into an aponeurosis which descends with muscular fibers given off and gradually contracting to unite with the tendon of the soleus to form the Achilles tendon.<br>Soleus - A broad, flat muscle situated beneath the gastrocemius. It arises from the posterior head of the fibula and from the upper ⅓ of the shaft of the fibula, from the oblique line of the tibia and from the middle ⅓ of the inner border of the tibia. The fibres pan backward to an aponeurosis which covers the posterior surface. It becomes thicker and narrower as it descends, joining with the tendon of the gastrocnemius and forming the Achilles tendon.<br>Achilles Tendon - Arises as described above commencing about the middle part of the leg. Gradually contracting below it is |

-continued

| Eyelet Location | Action | Corresponding Anatomical References |
|---|---|---|
| | | inserted into the lower part of the posterior surface of the os calcis. The tendon spreads out at its lower end so that its narrowest part is usually about 1" to 1½' above its insertion. |
| J. | Keeps tendons in place and controls the angle of draw. | Peroneal Retinaculum |
| H. | Draws the posterior lateral portion of the ankle area of the shell upwards towards the superior, lateral area of the fibula and everts the shell. | Abductor Minimi Digiti and Peroneus Longus<br>Peroneus Longus arises from the head and upper ⅔ of the outer surface of the fibula; from the deep surface of the facia; and from the intermuscular septa between it and the muscles on the front of the fibula. It terminates in a long tendon which passes behind the lateral malleolus, obliquely forward across the lateral side of the os calcis, and reaching the lateral side of the cuboid, it runs in a groove under that bone crossing the sole of the foot obliquely and is inserted into the lateral side of the base of the first metatarsal and the internal cuneiform bone.<br>Abductor Minimi Digiti arises from the lateral tubercle of the os calcis, from the under surface of os calcis and gliding forward is inserted into the lateral side of the base of the proximal phalanx of 5th toe. |
| F. | Draws the anterior lateral portion of the ankle area of the shell upwards toward the lower ⅔ of the lateral side of the fibula and everts the shell. | Peroneus Brevis lies beneath the peroneus longus. It arises from the lower ⅔ of the lateral side of the shaft of the fibula and from the intermuscular septa septa separating it from adjacent muscles. It passes vertically downward, becoming a tendon that runs behind the lateral malleous, along the lateral side of os calcis and is inserted into the tuberosity at the base of the 5th metatarsal on its lateral side. |

Figure 15:
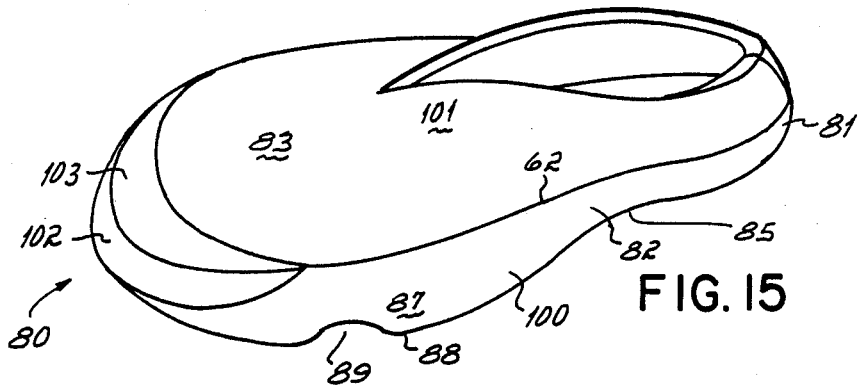
FIG. 15 is a diagrammatic perspective view of the shell of the FIG. 12 embodiment assembled.
Figure 16:
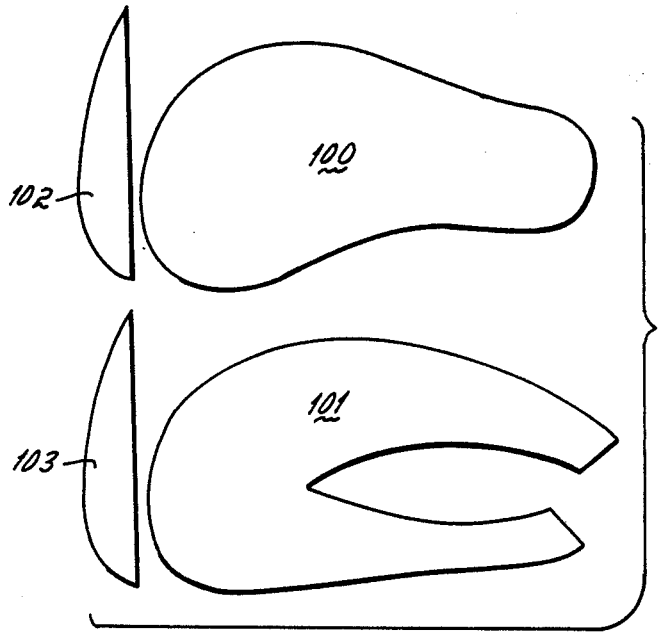
FIG. 16 is a plan view of the components used in the assembly of the shell of FIG. 15.
Figure 17:
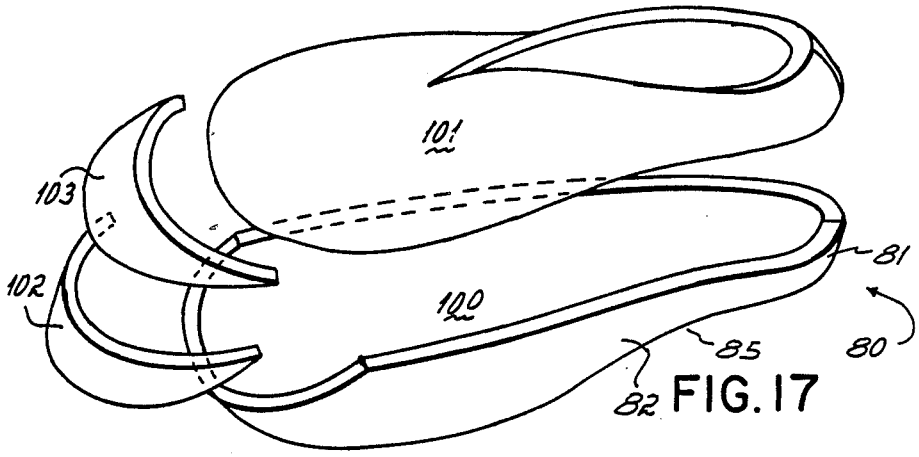
FIG. 17 is a disassembled diagrammatic perspective view of the shell of FIG. 15.

The shell in this embodiment may be made of four sections as shown at FIGS. 15 and 16. These sections are respectively a lower section 100, an upper section 101 and two toe portions 102 and 103. Those sections 100–103 are joined together edge-to-edge as shown in FIG. 15 to provide the contoured shell described above. It should be understood that other patterns or shell-forming techniques can be employed, such as injection molding, blow molding, etc., without departing from the scope of the present invention.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. Footwear comprising:

a hollow shell having an opening in the upper rear portion thereof through which a foot may be inserted, said shell having a median line around the perimeter of the shell dividing the shell into substantially equal upper and lower masses, an elastic band for drawing said shell against the foot contour, said band having plural connections to said shell, the band connections in the area of the ankle being below said median line, the band connections fore and aft of said ankle area being above said median line, whereby the lower portions of said shell on each side of the ankle area are drawn upwardly, and the upper portions of the footwear are drawn toward each other.

2. Footwear as in claim 1 in which said band has six connection points on each side of said shell, two connection points being at the heel area of the shell above said median line, two connection points being at the ankle area below the median line, and two connection points being over the forefoot area above the median line.

3. Footwear as in claim 2 further comprising:

an elastic band section on each side of said shell extending generally parallel to and above said median line to interconnect said band connection points above the median line, thereby applying a forward and upward force to the heel portion of said shell, an upward force to the ankle area of said shell and a forward and upward force to the forefoot area of said shell.

4. Footwear comprising:

a hollow shell having an opening in the upper rear portion thereof through which a foot may be inserted, said shell having a median line around the perimeter of said shell dividing said shell into substantially equal upper and lower masses, said shell having a heel area at a rear end, a forefoot area at the front end, and an ankle area between said heel area and said forefoot area, on each side of said shoe a pair of eyelets within said heel area above said median line, a pair of eyelets within said ankle area below said median line and a pair of eyelets within said forefoot area above said median line, an elastic band having a first section passing seriatum through said eyelets from said forefoot area to said heel area, and a second section passing generally parallel to said median line from said heel eyelets to said forefoot eyelets, said second section passing under said first section, said second section, when stretched, pulling up on the first section to lift the ankle area of said shell.

5. Footwear comprising:

a lower piece, an upper piece substantially identical to the lower piece, each piece being a flexible material having a thickness of at least about 0.125 inch, each piece having an edge, said edges of said upper and lower pieces being joined to form a shell which accommodates the contours of the human foot, said upper piece having an opening through which a foot may be inserted, an elastic band having connections to said shell around said opening to snug said shell against the foot contour, said shoe having a median line around the perimeter of said shell dividing the shell into substantially equal upper and lower masses, the band connections in the area of the ankle being below said median line, the band connections fore and aft of said ankle area being above said median line.

6. Footwear comprising a flexible, hollow shell having an opening in the upper portion thereof through which a foot may be inserted, an elastic band extending substantially entirely around the said opening and being connected to said shell, said shell being divided transversely at the area of the ankle, and longitudinally about the centerline of the shell, thereby dividing said band into four quadrants:

forward inside
forward outside
rearward inside
rearward outside said elastic band being under tension when applied to a foot and coacting as follows:

when the foot is rotated in relation to the ankle, fore and aft or side-to-side, two adjacent band quadrants will be stretched and the opposite band quadrants will contract, said shoe having a median line around the perimeter of said shell dividing the shell into substantially equal upper and lower masses, the band connections in the area of the ankle being below said median line, the band connections fore and aft of said ankle area being above said median line.

7. Footwear comprising:

a lower piece, an upper piece substantially identical to the lower piece, each piece being a flexible material having a thickness of at least about 0.125 inch, each piece having an edge, said edges of said upper and lower pieces being joined to form a shell which accommodates the contours of the human foot, said upper piece having an opening through which a foot may be inserted, an elastic band having connections to said shell around said opening to snug said shell against the foot contour, an achilles flap projecting upwardly from the head of said shell, said elastic band forming, at each side of said shell, a triangular truss, in tension extending from the bottom of said shell below the ankle, back to the bottom of said heel, to the upper portion of said flap, and return to the bottom of said shell below the ankle.

8. Footwear comprising a flexible, hollow shell having an opening in the upper portion thereof through which a foot may be inserted, an elastic band extending substantially entirely around the said opening and being connected to said shell, said shell being divided transversely at the area of the ankle, and longitudinally about the centerline of the shell, thereby dividing said band into four quadrants:

forward inside
forward outside
rearward inside
rearward outside said elastic band being under tension when applied to a foot and coacting as follows:

when the foot is rotated in relation to the ankle, fore and aft or side-to-side, two adjacent band quadrants will be stretched and the opposite band quadrants will contract, an achilles flap projecting upwardly from the head of said shell, said elastic band forming, at each side of said shell, a triangular truss, in tension extending from the bottom of said shell below the ankle, back to the bottom of said heel, to the upper portion of said flap, and return to the bottom of said shell below the ankle.

* * * * *